United States Patent [19]

Pukaite

[11] 3,936,568

[45] Feb. 3, 1976

[54] THICK FILM VARIABLE RESISTOR

[75] Inventor: Clifford Joseph Pukaite, Mequon, Wis.

[73] Assignee: Globe-Union Inc., Milwaukee, Wis.

[22] Filed: Nov. 7, 1974

[21] Appl. No.: 521,576

[52] U.S. Cl. ..... 428/333; 156/24; 427/103; 427/124; 427/125; 427/229; 428/148; 428/432; 338/162

[51] Int. Cl.[2] ..... B05D 5/12

[58] Field of Search ..... 117/217, 227, 212; 156/24; 338/162, 176; 427/103, 124, 125, 229; 428/148, 333, 432

[56] References Cited

UNITED STATES PATENTS

| | | | |
|---|---|---|---|
| 2,827,536 | 3/1958 | Moore et al. | 338/162 |
| 3,206,702 | 9/1965 | Greenwood | 338/162 |
| 3,319,320 | 5/1967 | Cruthers | 338/162 |
| 3,324,440 | 6/1967 | Strief et al. | 338/162 |
| 3,326,720 | 6/1967 | Bruhl, Jr. et al. | 117/227 |
| 3,370,948 | 2/1968 | Rosenbauer | 156/24 |
| 3,379,567 | 4/1968 | Wright | 117/227 |
| 3,573,948 | 4/1971 | Tarnopol | 156/24 |

*Primary Examiner*—Cameron K. Weiffenbach
*Attorney, Agent, or Firm*—James L. Kirschnik; John Phillip Ryan

[57] ABSTRACT

An improved thick film resistor for use with variable resistor applications includes a gold overlay applied to the contact surface of the thick film resistor after first etching the contact surface with acid. The combination of the gold overlay and acid etching of the contact surface reduces contact resistance and the contact resistance variation and provides improved wear resistance of the contact surface in a variable resistor element.

7 Claims, 2 Drawing Figures

Fig. 1
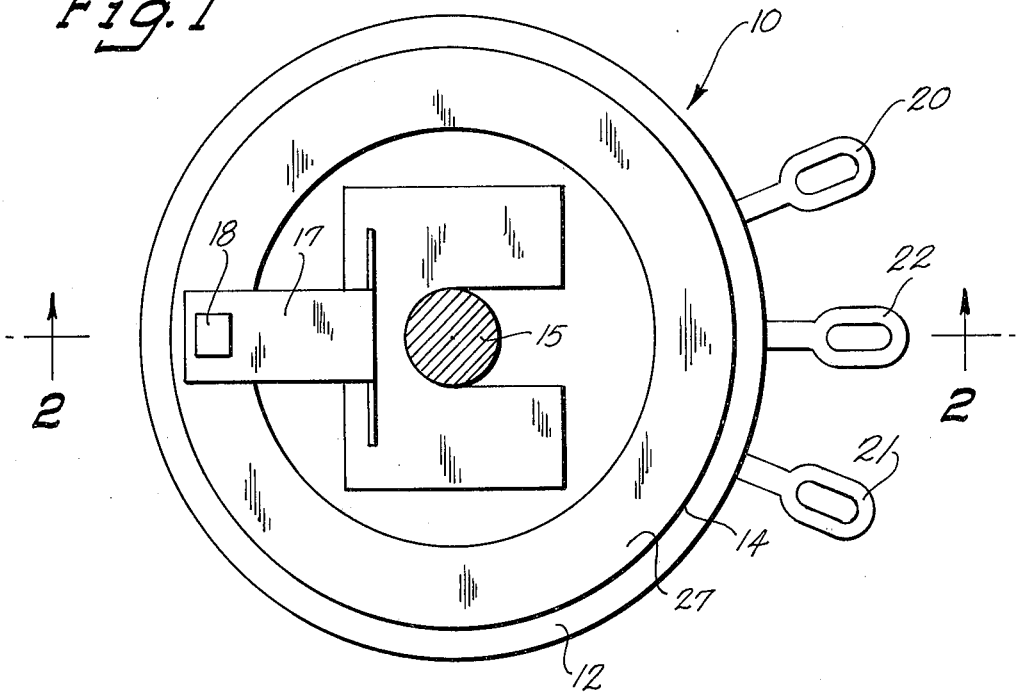
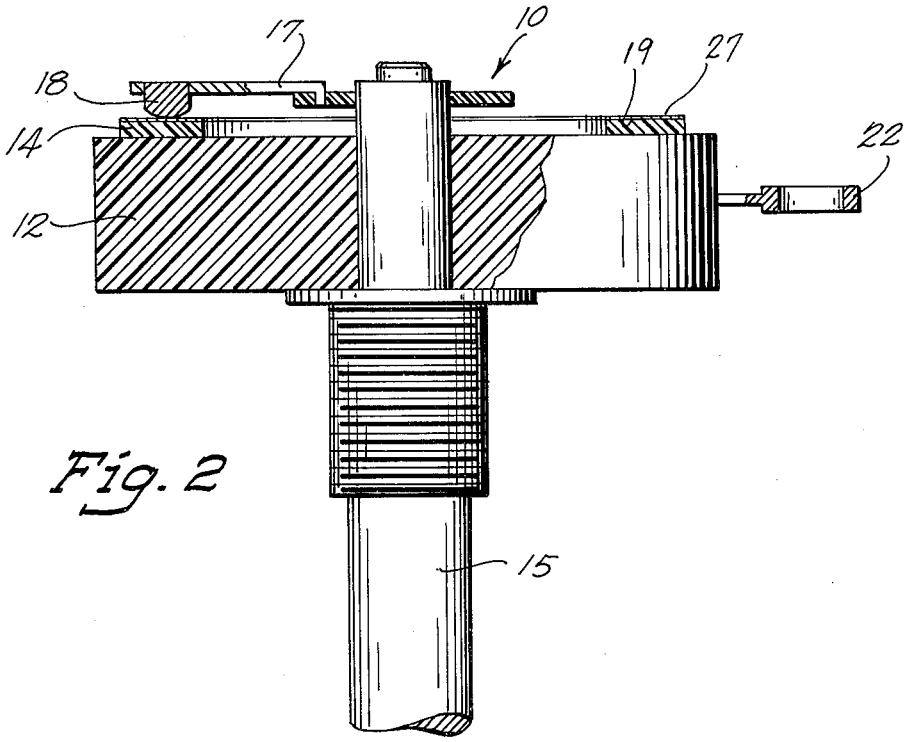
Fig. 2

THICK FILM VARIABLE RESISTOR

BACKGROUND OF THE INVENTION

Thick film or cermet resistor materials are often utilized in variable resistors or potentiometers. Thick film resistors generally comprise an amorphous ceramic material containing a predetermined quantity of a conductive metal or metallic oxide with the amount of the metallic material determining the electrical resistivity of the resistor element. Examples of such resistors are described in U.S. Pat. No. 2,950,995, Place et al., Aug. 30, 1960; U.S. Pat. No. 2,950,996, Place et al., Aug. 30, 1960; U.S. Pat. No. 3,052,573, Dumesnil, Sept. 4, 1962; U.S. Pat. No. D'Andrea, Feb. 9, 1960; U.S. Pat. No. 3,304,199, Faber et al., Feb. 14, 1967; and U.S. Pat. No. 3,899,499, Pukaite Aug. 12, 1975 assigned to the assignee of the present invention.

A problem with the use of cermet resistors in potentiometers or variable resistors exists with regard to excessive contact resistance between the contact wiper and the resistor element. Variations in the contact resistance also result in electrical noise. Additionally, excessive wear of the resistor and/or wiper contact is a problem. Various attempts have been made to eliminate the aforesaid problems as evidenced by the U.S. Pat. No. 3,597,720, Burgess Aug. 3, 1971; and U.S. Pat. No. 3,717,837, MacLachlan Feb. 20, 1973. MacLachlan teaches the use of a diffused layer of gold on the contact surface of a thin film cermet resistor to reduce contact noise. Burgess teaches the use of a conductive resinous polymerizate wiper contact.

SUMMARY OF THE INVENTION

It is an object of the invention to provide an improved thick film resistor for use in variable resistors.

A further object of the invention is to provide a thick film resistor for use in variable resistors having decreased contact resistance and contact resistance variation, and having improved wear qualities.

Other objects and advantages of the invention will become apparent from the description of the preferred embodiment which follows.

The invention basically comprises a thick film resistor comprising an amorphous ceramic material in which the contact surface of the resistor is etched with acid and has an overlay of a noble metal to reduce contact resistance and the contact resistance variation and to improve the wear resistance of the resistor contact surface.

DESCRIPTION OF THE DRAWING

FIG. 1 is a plan of a potentiometer incorporating the present invention; and

FIG. 2 is a view taken along line 2—2 of FIG. 1.

DESCRIPTION OF THE PREFERRED EMBODIMENT

Referring to FIGS. 1 and 2, a potentiometer 10 comprises a base or substrate 12 having a generally annular shaped resistor element 14 affixed thereto. Substrate 12 may be made of any suitable non-conductive ceramic material such as alumina. A rotatable shaft 15 extends through the base 12 and resistor 14 and carries a wiper arm 17 having a contact 18 at its extreme end for engaging the contact surface 19 of the resistor 14. A pair of terminals 20 and 21 may be provided which are connected to the opposite ends of the resistor element 14 and a terminal 22 may be provided which is electrically connected to the wiper arm 17 and contact 18 in a conventional manner. The construction and operation of potentiometer 10 is well known in the art and need not be discussed in further detail.

The resistor element 14 may be made of any suitable thick film resistive material which contains a predetermined percentage of a conductive material providing a value of electrical resistance of the element 14. Resistor element 14 may be applied to the substrate 12 in a manner well known in the art. Typically, the resistor composition is a mixture of an organic vehicle and a thick film resistive material. The resulting fluid mixture may be applied to the substrate 12 by any conventional method such as silk screening, dipping or brushing. After drying the screened resistor paint to remove the organic vehicle, the resistor is fired at an elevated temperature which varies with the particular resistor composition used. It has been found that firing of the resistor 14 results in a thin glass rich surface film at the resistor contact surface 19. The glass rich film layer present on cermet resistors of this type is believed to account for the superior hermeticity of such resistors by isolating the conductive phase material from environmental effects. It is believed, however, that the presence of the glassy film acts to inhibit proper functioning of the resistor material for use as a variable resistor by increasing the contact resistance, and by increasing the contact resistance variation.

In an attempt to overcome the relatively high contact resistance and contact resistance variations present in thick film resistance materials, a thick film resistor 14 was prepared in a conventional manner. The resistor contact surface 19 was then etched with hydrofluoric acid to remove the glassy surface layer. Etching was accomplished by immersing the fired resistor 14 in a dilute hydrofluoric acid solution. A solution of 3 percent hydrofluoric acid and immersion time of 45 seconds was found to be suitable. Additionally, a five percent acid solution and immersion time of 30–45 seconds was also suitable. Other acids such as a 0.5 percent hydrofluoric acid solution, a 2.5 percent hydrochloric acid - alcohol solution, and a boiling phosphoric acid solution, were also found to be satisfactory.

After etching the top surface 19 of the resistor 14, a thin overlay of gold 27 was applied to the resistor surface 19. The gold was applied by vacuum evaporation, however, an application of the metal by organo-metallic resinate decomposition was also found to be suitable. Gold was applied in film thicknesses ranging from 50 to 400 Angstroms. While no marked difference in contact resistance variation was exhibited over this range of film thickness, either initially or after cycling, the contact resistance was noted to be slightly better for metallic film thicknesses greater than 200 Angstroms. The following table illustrates the results of testing of a number of resistor elements prepared as above noted.

TABLE 1

Effect of Gold Film Thickness

| Potentiometer No. | Gold Thickness A | Contact Resistance (%) | | Contact Resistance Variation (%) | |
|---|---|---|---|---|---|
| | | Initial | Cycled | Initial | Cycled |
| 1 | 50 | 0.30 | 0.60 | 0.30 | 0.27 |
| 2 | 50 | 0.40 | 0.80 | 0.13 | 0.53 |
| 3 | 50 | 0.27 | 1.00 | 0.10 | 1.00 |

TABLE 1-continued

Effect of Gold Film Thickness

| Potentiometer No. | Gold Thickness A | Contact Resistance (%) Initial | Contact Resistance (%) Cycled | Contact Resistance Variation (%) Initial | Contact Resistance Variation (%) Cycled |
|---|---|---|---|---|---|
| 4 | 50 | 0.33 | 0.73 | 0.20 | 0.33 |
| 5 | 50 | 0.20 | 0.73 | 0.10 | 0.53 |
| 6 | 100 | 0.45 | 0.95 | 0.15 | 0.50 |
| 7 | 100 | 0.33 | 0.73 | 0.10 | 0.40 |
| 8 | 100 | 0.27 | 0.63 | 0.10 | 0.47 |
| 9 | 100 | 0.40 | 0.80 | 0.13 | 0.53 |
| 10 | 100 | 0.33 | 0.90 | 0.20 | 0.47 |
| 11 | 200 | 0.13 | 0.47 | 0.13 | 0.53 |
| 12 | 200 | 0.13 | 0.60 | 0.13 | 0.40 |
| 13 | 400 | 0.13 | 0.33 | 0.10 | 0.20 |
| 14 | 400 | 0.10 | 0.40 | 0.10 | 0.27 |

Potentiometers 1 – 10 Cycled 100,000 Times
Potentiometers 11 – 14 Cycled 20,000 Times Further investigation of the performance of potentiometers having an etched cermet resistor surface and gold overlay indicate that a preferred slider contact comprises a hard sintered carbon brush. Carbon brushes filled with polymeric material, although providing somewhat better contact resistance were found to wear excessively leaving large deposits of carbon on the resistor tract causing changes in the resistance. Similarly, nickel-silver wipers and gold-7.4 vol. % $MoSi_2$ brushes were found to wear excessively also.

In addition to resistor elements having a gold overlay, thin films of silver and platinum were also found to be suitable and result in equivalent reductions of contact resistance and contact resistance variation.

While one embodiment of the invention has thus been described, the invention is not to be limited thereby but is to be taken solely by an interpretation of the claims which follow.

I claim:

1. A thick film resistor for use in a variable resistor or potentiometer comprising:

an insulating substrate a thick film resistor layer attached to said substrate, said resistor layer comprising an amorphous ceramic material containing a predetermined amount of conductive material and having an exposed contact surface, said contact surface being etched with acid, and a thin layer of a conductive metal selected from the group consisting of gold, silver or platinum deposited on said etched surface.

2. A thick film resistor as recited in claim 1 wherein:

said thin layer of conductive metal has a thickness in the range of 50 to 400 Angstroms.

3. A thick film resistor as recited in claim 1 wherein:

said layer of conductive metal has a thickness in the range of 200 to 400 Angstroms.

4. A method of making a thick film resistor for use in a potentiometer or variable resistor comprising the steps of:

forming a fluid mixture of a thick film resistive material and an organic vehicle;

applying a film of said mixture to a non-conductive ceramic substrate;

firing said mixture and said substrate at an elevated temperature to remove said organic vehicle;

etching the exposed surface of said resistor film with acid; and applying a thin layer of a conductive metal selected from the group consisting of gold, silver or platinum to said etched surface.

5. A method as recited in claim 4 wherein:

said thin layer of conductive metal is applied by vacuum evaporation.

6. A method as recited in claim 4 wherein:

said thin layer of conductive metal is applied by organo-metallic resinate decomposition.

7. A method as recited in claim 4 wherein:

said etching step is accomplished by immersing said exposed surface of said resistor material in a 3 to 5 percent hydroflouric acid solution for 30 to 45 seconds.

* * * * *